US007290398B2

(12) United States Patent
Wallace et al.

(10) Patent No.: US 7,290,398 B2
(45) Date of Patent: Nov. 6, 2007

(54) REFRIGERATION CONTROL SYSTEM

(75) Inventors: John G. Wallace, Acworth, GA (US); David R. Rohn, Canton, GA (US); Alan E. Mayne, Peachtree City, GA (US); Nagaraj Jayanth, Sidney, OH (US); Troy W. Renken, Troy, OH (US)

(73) Assignee: Computer Process Controls, Inc., Kennesaw, GA (US)

( * ) Notice: Subject to any disclaimer, the term of this patent is extended or adjusted under 35 U.S.C. 154(b) by 498 days.

(21) Appl. No.: 10/925,899

(22) Filed: Aug. 25, 2004

(65) Prior Publication Data

US 2005/0076659 A1 Apr. 14, 2005

Related U.S. Application Data

(60) Provisional application No. 60/497,616, filed on Aug. 25, 2003.

(51) Int. Cl.

| | |
|---|---|
| ***G05D 23/32*** | (2006.01) |
| ***F28D 5/00*** | (2006.01) |
| ***G01K 13/00*** | (2006.01) |
| ***F25B 19/00*** | (2006.01) |

(52) U.S. Cl. ..... 62/157; 62/129; 62/231; 702/183

(58) Field of Classification Search ..... 62/157, 62/129, 231; 417/18, 32, 44.1; 418/55.1, 418/55.5; 702/184, 185, 183, 182
See application file for complete search history.

(56) References Cited

U.S. PATENT DOCUMENTS

| | | | |
|---|---|---|---|
| 2,296,822 | A | 9/1942 | Wolfert |
| 3,232,519 | A | 2/1966 | Long |
| 3,513,662 | A | 5/1970 | Golber |
| 3,585,451 | A | 6/1971 | Day |
| 3,653,783 | A | 4/1972 | Sauder |
| 3,735,377 | A | 5/1973 | Kaufman |
| 3,767,328 | A | 10/1973 | Ladusaw |
| 3,783,681 | A | 1/1974 | Hirt et al. |
| 3,924,972 | A | 12/1975 | Szymaszek |
| 4,060,716 | A | 11/1977 | Pekrul et al. |
| 4,090,248 | A | 5/1978 | Swanson et al. |
| 4,102,150 | A | 7/1978 | Kountz |

(Continued)

FOREIGN PATENT DOCUMENTS

| | | |
|---|---|---|
| CH | 173493 | 11/1934 |

(Continued)

OTHER PUBLICATIONS

European Search Report for EP 01 30 1752; Mar. 26, 2002; 4 Pages.

(Continued)

*Primary Examiner*—Chen Wen Jiang
(74) *Attorney, Agent, or Firm*—Harness, Dickey & Pierce, P.L.C.

(57) ABSTRACT

A refrigeration system and method includes a refrigeration component and an electronics module preconfigured with a data set for the refrigeration component. The electronics module stores the data set including identification and configuration parameters of the refrigeration component. A refrigeration system controller that communicates with the electronics module to copy the data set and to regulate operation of the refrigeration component within the refrigeration system.

56 Claims, 1 Drawing Sheet

U.S. PATENT DOCUMENTS

| | | | |
|---|---|---|---|
| 4,102,394 | A | 7/1978 | Botts |
| 4,112,703 | A | 9/1978 | Kountz |
| 4,132,086 | A | 1/1979 | Kountz |
| 4,151,725 | A | 5/1979 | Kountz et al. |
| 4,281,358 | A | 7/1981 | Plouffe et al. |
| 4,345,162 | A | 8/1982 | Hammer et al. |
| 4,372,119 | A | 2/1983 | Gillbrand et al. |
| 4,384,462 | A | 5/1983 | Overman et al. |
| 4,390,321 | A | 6/1983 | Langlois et al. |
| 4,390,922 | A | 6/1983 | Pelliccia |
| 4,399,548 | A | 8/1983 | Castleberry |
| 4,420,947 | A | 12/1983 | Yoshino |
| 4,425,010 | A | 1/1984 | Bryant et al. |
| 4,429,578 | A | 2/1984 | Darrel et al. |
| 4,434,390 | A | 2/1984 | Elms |
| 4,463,576 | A | 8/1984 | Burnett et al. |
| 4,467,613 | A | 8/1984 | Behr et al. |
| 4,470,092 | A | 9/1984 | Lombardi |
| 4,479,389 | A | 10/1984 | Anderson, III et al. |
| 4,494,383 | A | 1/1985 | Nagatomo et al. |
| 4,497,031 | A | 1/1985 | Froehling et al. |
| 4,502,842 | A | 3/1985 | Currier et al. |
| 4,502,843 | A | 3/1985 | Martin |
| 4,505,125 | A | 3/1985 | Baglione |
| 4,506,518 | A | 3/1985 | Yoshikawa et al. |
| 4,510,576 | A | 4/1985 | MacArthur et al. |
| 4,520,674 | A | 6/1985 | Canada et al. |
| 4,540,040 | A | 9/1985 | Fukumoto et al. |
| 4,555,910 | A | 12/1985 | Sturges |
| 4,563,878 | A | 1/1986 | Baglione |
| 4,575,318 | A | 3/1986 | Blain |
| 4,580,947 | A | 4/1986 | Shibata et al. |
| 4,604,036 | A | 8/1986 | Sutou et al. |
| 4,614,089 | A | 9/1986 | Dorsey |
| 4,630,670 | A | 12/1986 | Wellman et al. |
| 4,653,280 | A | 3/1987 | Hansen et al. |
| 4,655,688 | A | 4/1987 | Bohn et al. |
| 4,660,386 | A | 4/1987 | Hansen et al. |
| 4,715,792 | A | 12/1987 | Nishizawa et al. |
| 4,755,957 | A | 7/1988 | White et al. |
| 4,787,213 | A | 11/1988 | Gras et al. |
| 4,798,055 | A | 1/1989 | Murray et al. |
| 4,831,560 | A | 5/1989 | Zaleski |
| 4,831,832 | A | 5/1989 | Alsenz |
| 4,838,037 | A | 6/1989 | Wood |
| 4,856,286 | A | 8/1989 | Sulfstede et al. |
| 4,877,382 | A | 10/1989 | Caillat et al. |
| 4,881,184 | A | 11/1989 | Abegg, III et al. |
| 4,882,747 | A | 11/1989 | Williams |
| 4,884,412 | A | 12/1989 | Sellers et al. |
| 4,885,707 | A | 12/1989 | Nichol et al. |
| 4,904,993 | A | 2/1990 | Sato |
| 4,909,076 | A | 3/1990 | Busch et al. |
| 4,913,625 | A | 4/1990 | Gerlowski |
| 4,928,750 | A | 5/1990 | Nurczyk |
| 4,949,550 | A | 8/1990 | Hanson |
| 4,964,060 | A | 10/1990 | Hartsog |
| 4,974,427 | A | 12/1990 | Diab |
| 4,985,857 | A | 1/1991 | Bajpai et al. |
| 5,009,074 | A | 4/1991 | Goubeaux et al. |
| 5,018,357 | A | 5/1991 | Livingstone et al. |
| 5,022,234 | A | 6/1991 | Goubeaux et al. |
| 5,051,720 | A | 9/1991 | Kittirutsunetorn |
| 5,056,036 | A | 10/1991 | Van Bork |
| 5,058,388 | A | 10/1991 | Shaw et al. |
| 5,071,065 | A | 12/1991 | Aalto et al. |
| 5,073,862 | A | 12/1991 | Carlson |
| 5,076,067 | A | 12/1991 | Prenger et al. |
| 5,086,385 | A | 2/1992 | Launey et al. |
| 5,088,297 | A | 2/1992 | Maruyama et al. |
| 5,099,654 | A | 3/1992 | Baruschke et al. |
| 5,109,222 | A | 4/1992 | Welty |
| 5,109,700 | A | 5/1992 | Hicho |
| 5,115,406 | A | 5/1992 | Zatezalo et al. |
| 5,119,466 | A | 6/1992 | Suzuki |
| 5,131,237 | A | 7/1992 | Valbjorn |
| 5,156,539 | A | 10/1992 | Anderson et al. |
| 5,181,389 | A | 1/1993 | Hanson et al. |
| 5,203,178 | A | 4/1993 | Shyu |
| 5,203,179 | A | 4/1993 | Powell |
| 5,209,076 | A | 5/1993 | Kauffman et al. |
| 5,209,400 | A | 5/1993 | Winslow et al. |
| 5,224,835 | A | 7/1993 | Oltman |
| 5,226,472 | A | 7/1993 | Benevelli et al. |
| 5,243,827 | A | 9/1993 | Hagita et al. |
| 5,265,434 | A | 11/1993 | Alsenz |
| 5,279,458 | A | 1/1994 | DeWolf et al. |
| 5,282,728 | A | 2/1994 | Swain |
| 5,284,026 | A | 2/1994 | Powell |
| 5,299,504 | A | 4/1994 | Abele |
| 5,303,560 | A | 4/1994 | Hanson et al. |
| 5,311,451 | A | 5/1994 | Barrett |
| 5,316,448 | A | 5/1994 | Ziegler et al. |
| 5,335,507 | A | 8/1994 | Powell |
| 5,362,206 | A | 11/1994 | Westerman et al. |
| 5,381,692 | A | 1/1995 | Winslow et al. |
| 5,415,008 | A | 5/1995 | Bessler |
| 5,416,781 | A | 5/1995 | Ruiz |
| 5,423,190 | A | 6/1995 | Friedland |
| 5,423,192 | A | 6/1995 | Young et al. |
| 5,426,952 | A | 6/1995 | Bessler |
| 5,431,026 | A | 7/1995 | Jaster |
| 5,435,145 | A | 7/1995 | Jaster |
| 5,440,890 | A | 8/1995 | Bahel et al. |
| 5,440,891 | A | 8/1995 | Hindmon, Jr. et al. |
| 5,440,895 | A | 8/1995 | Bahel et al. |
| 5,446,677 | A | 8/1995 | Jensen et al. |
| 5,450,359 | A | 9/1995 | Sharma et al. |
| 5,452,291 | A | 9/1995 | Eisenhandler et al. |
| 5,454,229 | A | 10/1995 | Hanson et al. |
| 5,460,006 | A | 10/1995 | Torimitsu |
| 5,467,264 | A | 11/1995 | Rauch et al. |
| 5,481,481 | A | 1/1996 | Frey et al. |
| 5,483,141 | A | 1/1996 | Uesugi |
| 5,509,786 | A | 4/1996 | Mizutani et al. |
| 5,511,387 | A | 4/1996 | Tinsler |
| 5,519,301 | A | 5/1996 | Yoshida et al. |
| 5,528,908 | A | 6/1996 | Bahel et al. |
| 5,546,756 | A | 8/1996 | Ali |
| 5,546,757 | A | 8/1996 | Whipple, III |
| 5,548,966 | A | 8/1996 | Tinsler |
| 5,570,085 | A | 10/1996 | Bertsch |
| 5,570,258 | A | 10/1996 | Manning |
| 5,572,643 | A | 11/1996 | Judson |
| 5,596,507 | A | 1/1997 | Jones et al. |
| 5,602,757 | A | 2/1997 | Haseley et al. |
| 5,610,339 | A | 3/1997 | Haseley et al. |
| 5,630,325 | A | 5/1997 | Bahel et al. |
| 5,641,270 | A | 6/1997 | Sgourakes et al. |
| 5,655,379 | A | 8/1997 | Jaster et al. |
| 5,655,380 | A | 8/1997 | Calton |
| 5,694,010 | A | 12/1997 | Oomura et al. |
| 5,707,210 | A | 1/1998 | Ramsey et al. |
| 5,713,724 | A | 2/1998 | Centers et al. |
| 5,715,704 | A | 2/1998 | Cholkeri et al. |
| 5,741,120 | A | 4/1998 | Bass et al. |
| 5,743,109 | A | 4/1998 | Schulak |
| 5,752,385 | A | 5/1998 | Nelson |
| 5,875,430 | A | 2/1999 | Koether |
| 5,875,638 | A | 3/1999 | Tinsler |
| 5,900,801 | A | 5/1999 | Heagle et al. |
| 5,904,049 | A | 5/1999 | Jaster et al. |
| 5,924,295 | A | 7/1999 | Park |
| 5,939,974 | A | 8/1999 | Heagle et al. |

| | | | |
|---|---|---|---|
| 5,946,922 | A | 9/1999 | Viard et al. |
| 5,947,693 | A | 9/1999 | Yang |
| 5,953,490 | A | 9/1999 | Wiklund et al. |
| 5,956,658 | A | 9/1999 | McMahon |
| 5,975,854 | A | 11/1999 | Culp, III et al. |
| 5,984,645 | A | 11/1999 | Cummings |
| 6,006,171 | A | 12/1999 | Vines et al. |
| 6,035,661 | A | 3/2000 | Sunaga et al. |
| 6,038,871 | A | 3/2000 | Gutierrez et al. |
| 6,047,557 | A | 4/2000 | Pham et al. |
| 6,081,750 | A | 6/2000 | Hoffberg et al. |
| 6,098,893 | A | 8/2000 | Berglund et al. |
| 6,125,642 | A | 10/2000 | Seener et al. |
| 6,129,527 | A | 10/2000 | Donahoe et al. |
| 6,153,993 | A | 11/2000 | Oomura et al. |
| 6,176,686 | B1 | 1/2001 | Wallis et al. |
| 6,179,214 | B1 | 1/2001 | Key et al. |
| 6,191,545 | B1 | 2/2001 | Kawabata et al. |
| 6,213,731 | B1 | 4/2001 | Doepker et al. |
| 6,215,405 | B1 | 4/2001 | Handley et al. |
| 6,240,733 | B1 | 6/2001 | Brandon et al. |
| 6,240,736 | B1 | 6/2001 | Fujita et al. |
| 6,244,061 | B1 | 6/2001 | Takagi et al. |
| 6,266,968 | B1 | 7/2001 | Redlich |
| 6,276,901 | B1 | 8/2001 | Farr et al. |
| 6,290,043 | B1 | 9/2001 | Ginder et al. |
| 6,324,854 | B1 | 12/2001 | Jayanth |
| 6,378,315 | B1 | 4/2002 | Gelber et al. |
| 6,393,848 | B2 | 5/2002 | Roh et al. |
| 6,397,606 | B1 | 6/2002 | Roh et al. |
| 6,453,687 | B2 | 9/2002 | Sharood et al. |
| 6,471,486 | B1 | 10/2002 | Centers et al. |
| 6,502,409 | B1 | 1/2003 | Gatling et al. |
| 6,526,766 | B1 | 3/2003 | Hiraoka et al. |
| 6,553,774 | B1 | 4/2003 | Ishio et al. |
| 6,601,397 | B2 | 8/2003 | Pham et al. |
| 6,609,078 | B2 | 8/2003 | Starling et al. |
| 6,662,584 | B1 | 12/2003 | Whiteside |
| 6,675,591 | B2 | 1/2004 | Singh et al. |
| 6,892,546 | B2 | 5/2005 | Singh et al. |
| 6,996,441 | B1 | 2/2006 | Tobias |
| 7,024,870 | B2 | 4/2006 | Singh et al. |
| 2001/0025349 | A1 | 9/2001 | Sharood et al. |
| 2001/0054291 | A1 | 12/2001 | Roh et al. |
| 2002/0000092 | A1 | 1/2002 | Sharood et al. |
| 2002/0020175 | A1* | 2/2002 | Street et al. ..... 62/132 |
| 2002/0029575 | A1 | 3/2002 | Okamoto |
| 2002/0082924 | A1 | 6/2002 | Koether |
| 2002/0118106 | A1 | 8/2002 | Brenn |
| 2002/0161545 | A1 | 10/2002 | Starling et al. |
| 2002/0163436 | A1 | 11/2002 | Singh et al. |
| 2004/0239266 | A1 | 12/2004 | Lee et al. |
| 2004/0261431 | A1 | 12/2004 | Singh et al. |
| 2005/0204756 | A1 | 9/2005 | Dobmeier et al. |

FOREIGN PATENT DOCUMENTS

| | | | |
|---|---|---|---|
| DE | 842 351 | | 6/1952 |
| DE | 764 179 | | 4/1953 |
| DE | 1144461 | | 2/1963 |
| DE | 1403516 | | 10/1968 |
| DE | 1403467 | | 9/1969 |
| DE | 3133502 | | 6/1982 |
| DE | 3422398 | | 12/1985 |
| EP | 0 085 246 | | 8/1983 |
| EP | 0 254 253 | | 1/1988 |
| EP | 0 351 833 | | 7/1989 |
| EP | 0 410 330 | | 1/1991 |
| EP | 0419857 | | 4/1991 |
| EP | 0 453 302 | A1 | 10/1991 |
| EP | 0 479 421 | | 4/1992 |
| EP | 0 557 023 | | 8/1993 |
| EP | 0 579 374 | A1 | 1/1994 |
| EP | 0 660 213 | A2 | 6/1995 |
| EP | 0 747 598 | A2 | 12/1996 |
| EP | 0 877 462 | A2 | 11/1998 |
| EP | 0 982 497 | A1 | 3/2000 |
| EP | 1 087 142 | | 3/2001 |
| EP | 1 138 949 | | 10/2001 |
| EP | 1 139 037 | | 10/2001 |
| EP | 1187021 | A2 | 3/2002 |
| EP | 1 209 427 | A1 | 5/2002 |
| EP | 1 241 417 | A1 | 9/2002 |
| FR | 2582430 | | 11/1986 |
| FR | 2589561 | | 7/1987 |
| FR | 2628558 | | 9/1989 |
| FR | 2660739 | | 10/1991 |
| GB | 2 062 919 | A | 5/1981 |
| GB | 2 064 818 | | 6/1981 |
| GB | 2 116 635 | | 9/1983 |
| JP | 56-10639 | | 3/1981 |
| JP | 59-145392 | | 8/1984 |
| JP | 61-046485 | | 3/1986 |
| JP | 02110242 | | 4/1990 |
| JP | 02294580 | | 12/1990 |
| JP | 04080578 | | 3/1992 |
| JP | 06058273 | | 3/1994 |
| JP | 08-284842 | | 10/1996 |
| JP | 2005241089 | | 9/2005 |
| JP | 2005345096 | | 12/2005 |
| WO | WO 8601262 | | 2/1986 |
| WO | WO 8703988 | | 7/1987 |
| WO | WO 8802527 | | 4/1988 |
| WO | WO 9718636 | | 5/1997 |
| WO | WO 9917066 | | 4/1999 |
| WO | WO 02/14968 | | 2/2002 |
| WO | WO 02/090840 | | 11/2002 |
| WO | WO 02/090913 | | 11/2002 |
| WO | WO2005/022049 | | 3/2005 |
| WO | WO2006/091521 | | 8/2006 |

OTHER PUBLICATIONS

European Search Report for EP 82306809.3; Apr. 28, 1983; 1 Page.
European Search Report for EP 91 30 3518; Jul. 22, 1991; 1 Page.
European Search Report for EP 01 30 7547; Feb. 20, 2002; 1 Page.
European Search Report for EP 96 30 4219; Dec. 1, 1998; 2 Pages.
European Search Report for EP 99 30 6052; Dec. 28, 1999; 3 Pages.
European Search Report for EP 94 30 3484; Apr. 3, 1997; 1 Page.
European Search Report for EP 93 30 4470; Oct. 26, 1993; 1 Page.
European Search Report for EP 02 25 0266; May 17, 2002; 3 Pages.
European Search Report for EP 98 30 3525; May 28, 1999; 2 Pages.
International Search Report; International Application No. PCT/IB96/01435; May 23, 1997; 1 Page.
International Search Report; International Application No. PCT/US98/18710; Jan. 26, 1999; 1 Page.
First Office Action from the Patent Office of the People's Republic of China dated Jun. 8, 2007, Application No. 200480027753.6.
Translation of the First Office Action from the Patent Office of the People's Republic of China dated Jun. 8, 2007. Application No. 200480027753.6 (provided by CCPIT Patent and Trademark Law Office).
International Search Report, International Application No. PCT/US2006/040964, dated Feb. 15, 2007, 2 Pages.
European Search Report for EP 02 73 1544, Jun. 18, 2004, 2 Pages.
European Search Report for EP 02 72 9050, Jun. 17, 2004, 2 Pages.
International Search Report, International Application No. PCT/US02/13456, dated Aug. 22, 2002, 2 Pages.
International Search Report, International Application No. PCT/US2004/027654, dated Aug. 25, 2004, 4 Pages.
Pin Carmen, Baranyi Jozsef, Predictive Models as Means to Quantify the Interactions of Spoilage Organisms, International Journal of Food Microbiology, ol. 41, No. 1, 1998, pp. 59-72, XP-002285119.

* cited by examiner

REFRIGERATION CONTROL SYSTEM

CROSS-REFERENCE TO RELATED APPLICATIONS

This application claims the benefit of U.S. Provisional Application No. 60/497,616, filed on Aug. 25, 2003, the disclosure of which is incorporated herein by reference.

FIELD OF THE INVENTION

The present invention relates to refrigeration control systems, and more particularly to integrated control and monitoring of refrigeration system compressors.

BACKGROUND OF THE INVENTION

Refrigeration systems typically include a compressor, a condenser, an expansion valve, and an evaporator, all interconnected to form a fluid circuit. Cooling is accomplished through evaporation of a liquid refrigerant under reduced temperature and pressure. Vapor refrigerant is compressed to increase its temperature and pressure. The vapor refrigerant is condensed in the condenser, lowering its temperature to induce a state change from vapor to liquid.

The pressure of the liquid refrigerant is reduced through an expansion valve and the liquid refrigerant flows into the evaporator. The evaporator is in heat exchange relationship with a cooled area (e.g., an interior of a refrigeration case). Heat is transferred from the cooled area to the liquid refrigerant inducing a temperature increase sufficient to result in vaporization of the liquid refrigerant. The vapor refrigerant then flows from the evaporator to the compressor.

The refrigeration system can include multiple evaporators such as in the case of multiple refrigeration cases and multiple compressors connected in parallel in a compressor rack. The multiple compressors can be controlled individually or as a group to provide a desired suction pressure for the refrigeration system.

A system controller monitors and regulates operation of the refrigeration system based on control algorithms and inputs relating to the various system components. Such inputs include, but are not limited to, the number of compressors operating in the refrigeration system and the details of individual compressors, including compressor capacity and setpoints. During initial assembly of the refrigeration system, these inputs must be manually entered into the memory of the refrigeration controller. If a compressor is replaced, the inputs for the removed compressor must be manually erased from the memory and new inputs for the replacement compressor manually entered into the memory. Such manual entry of the inputs is time consuming and prone to human error.

SUMMARY OF THE INVENTION

Accordingly, the present invention provides a refrigeration system includes a refrigeration component and an electronics module that is attached to the refrigeration component. The electronics module stores a data set including identification and configuration parameters of the refrigeration component. A refrigeration system controller communicates with the electronics module to obtain the data set and to regulate operation of the refrigeration component within the refrigeration system.

In one feature, the refrigeration component is operable in a normal operating state and is inoperable in a lock-out state.

The refrigeration system controller monitors occurrences of the refrigeration component in the lock-out state.

In still another feature, the refrigeration component communicates initial configuration information to the refrigeration system controller upon assembly of the refrigeration component into the refrigeration system. The initial information includes operating parameters and component identity.

In yet another feature, the refrigeration component is a compressor. The controller regulates compressor capacity based on rated compressor capacity and current operating conditions of the compressor. The operating conditions include suction pressure, suction temperature, discharge pressure and discharge temperature.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
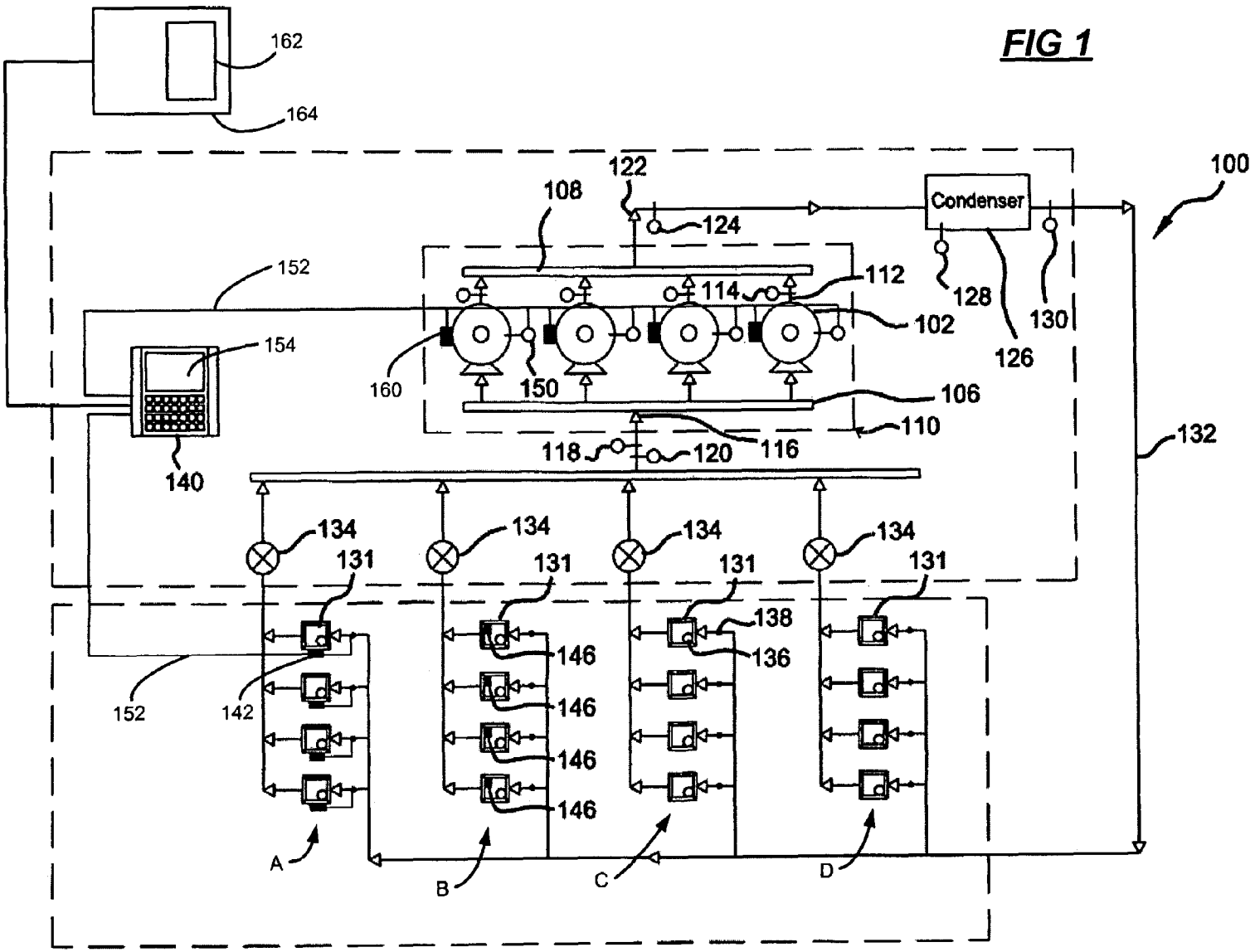
FIG. 1 is a schematic illustration of a refrigeration system according to the present invention.

The following description of the preferred embodiments is merely exemplary in nature and is in no way intended to limit the invention, its application, or uses.

Referring now to FIG. 1, an exemplary refrigeration system 100 includes a plurality of refrigerated food storage cases 102. It will be appreciated that the hereindescribed refrigeration system 100 is merely exemplary in nature. The refrigeration system 100 may vary as particular design requirements dictate.

As shown, the refrigeration system 100 includes a plurality of compressors 102 piped together with a common suction manifold 106 and a discharge header 108 all positioned within a compressor rack 110. A discharge output 112 of each compressor 102 includes a respective temperature sensor 114. An input 116 to the suction manifold 106 includes both a pressure sensor 118 and a temperature sensor 120. Further, a discharge outlet 122 of the discharge header 108 includes an associated pressure sensor 124.

The compressor rack 110 compresses refrigerant vapor that is delivered to a condenser 126 where the refrigerant vapor is liquefied at high pressure. The condenser 126 includes an associated ambient temperature sensor 128 and an outlet pressure sensor 130. This high-pressure liquid refrigerant is delivered to a plurality of refrigeration cases 131 by way of piping 132. Each refrigeration case 131 is arranged in separate circuits optionally including multiple refrigeration cases 131 that operate within a certain temperature range. FIG. 1 illustrates four (4) circuits labeled circuit A, circuit B, circuit C and circuit D. Each circuit A, B, C, D is shown to include four (4) refrigeration cases 131. Those skilled in the art, however, will recognize that any number of circuits, as well as any number of refrigeration cases 131 within a circuit, may be included. As indicated, each circuit will generally operate within a certain temperature range. For example, circuit A may be for frozen food, circuit B for dairy, circuit C for meat, and circuit D for produce.

Because the temperature requirement is different for each circuit, each circuit includes a pressure regulator 134 that acts to control the evaporator pressure and, hence, the temperature of the refrigerated space in the refrigeration cases 131. The pressure regulators 134 can be electronically or mechanically controlled. Each refrigeration case 131 also includes its own evaporator 136 and its own expansion valve 138 that may be either a mechanical or an electronic valve for controlling the superheat of the refrigerant. In this regard, refrigerant is delivered by piping to the evaporator 136 in each refrigeration case 131. The refrigerant passes through the expansion valve 138 where a pressure drop causes the high pressure liquid refrigerant to achieve a lower pressure combination of liquid and vapor. As hot air from the refrigeration case 131 moves across the evaporator 136 and cools the refrigerated space, the low pressure liquid turns into gas. This low pressure gas is delivered to the pressure regulator 134 associated with that particular circuit. At the pressure regulator 134, the pressure is dropped as the gas returns to the compressor rack 110. At the compressor rack 110, the low pressure gas is again compressed to a high pressure gas, which is delivered to the condenser 126. The condenser 126 provides a high pressure liquid that flows to the expansion valve 138, starting the refrigeration cycle again.

A main refrigeration controller 140 is used and configured or programmed to control the operation of the refrigeration system 100. The refrigeration controller 140 is preferably an Einstein Area Controller such as an Einstein 2 (E2) controller offered by CPC, Inc. of Atlanta, Ga., U.S.A., or any other type of programmable controller that may be programmed, as discussed herein. The refrigeration controller 140 controls the bank of compressors 104 in the compressor rack 110, via an electronics module 160, which may include relay switches to turn the compressors 102 on and off to provide the desired suction pressure. A case controller 142, such as a CC-100 case controller, also offered by CPC, Inc. of Atlanta, Ga., U.S.A., may be used to control the superheat of the refrigerant to each refrigeration case 131, via an electronic expansion valve in each refrigeration case 131 by way of a communication network or bus 152. Alternatively, a mechanical expansion valve may be used in place of the separate case controller. Should separate case controllers be utilized, the main refrigeration controller 140 may be used to configure each separate case controller, also via the communication bus 152. The communication bus 152 may operate using any communication protocol, e.g., an RS-485 communication bus or a LonWorks Echelon bus, that enables the main refrigeration controller 140 and the separate case controllers to receive information from each refrigeration case 131.

Each refrigeration case 131 may have a temperature sensor 146 associated therewith, as shown for circuit B. The temperature sensor 146 can be electronically or wirelessly connected to the controller 140 or the expansion valve for the refrigeration case 131. Each refrigeration case 131 in the circuit B may have a separate temperature sensor 146 to take average/minimum/maximum temperatures or a single temperature sensor 146 in one refrigeration case 131 within circuit B may be used to control each refrigeration case 131 in circuit B because all of the refrigeration cases 131 in a given circuit generally operate within a similar temperature range. These temperature inputs are provided to the main refrigeration controller 140 via the communication bus 152.

Additionally, further sensors can be provided and correspond with each component of the refrigeration system 100 and are in communication with the refrigeration controller 140. Energy sensors 150 are associated with the compressors 104 and condenser 126 of the refrigeration system 100. The energy sensors 150 monitor energy consumption of their respective components and communicate that information to the refrigeration controller 140.

The refrigeration controller 140 is configured to control and monitor system components such as suction groups, condensers, standard circuits, analog sensors, and digital sensors. The systems are monitored real-time. For suction groups, setpoints, status, capacity percentages, and stage activity for each suction group are displayed by an output of the refrigeration controller 140, such as a display screen 154. For circuits, circuit names, current status, and temperatures are displayed. For condensers, information on discharge setpoint and individual fan states is provided. The refrigeration controller 140 also includes a data table with default operating parameters for most commercially available refrigeration case types. By selecting a known case type, the refrigeration controller 140 automatically configures the default operating parameters, such as the setpoint, the number of defrosts per day and defrost time for the particular case type.

The compressors 102 include the embedded intelligence boards or electronics modules 160 that communicate compressor and system data to the refrigeration controller 140, as explained in further detail herein. Traditional I/O boards are replaced by the electronics modules 160, which communicate with the refrigeration controller 140. More specifically, the electronics modules 160 perform the I/O functions. The refrigeration controller 140 sends messages to the individual electronics modules 160 to provide control (e.g., compressor ON/OFF or unloader ON/OFF) and receives messages from the electronics modules 160 concerning the status of the electronics module 160 and the corresponding compressor 102.

The refrigeration controller 140 monitors the operating conditions of the compressors 102 including discharge temperature, discharge pressure, suction pressure and suction temperature. The compressor operating conditions influence the capacity of the individual compressors 102. The refrigeration controller 140 calculates the capacity of each compressor 102 using a compressor model based on the compressor Air-Conditioning and Refrigeration Institute (ARI) coefficients, discharge temperature, discharge pressure, suction pressure and suction temperature. The calculated capacities are then processed through a suction pressure algorithm to determine which compressors 102 to switch on/off to achieve the desired suction pressure.

Exemplary data received by the refrigeration controller 140 includes the number of compressors 102 in the refrigeration system 100, horsepower of each compressor, method of oil control/monitoring of the compressors, method of proofing the compressors 102 and the I/O points in the refrigeration controller 140 used to control the compressors 102. Much of the data is resident in the electronics module 160 of each of the compressors 102, as described in detail below and is therefore specific to that compressor. Other data is mined by the refrigeration controller 140 and is assembled in a controller database. In this manner, the refrigeration system 140 communicates with the individual electronics modules 160 to automatically populate the controller database and provide an initial system configuration. As a result, time consuming, manual input of these parameters is avoided.

The electronics module 160 of the individual compressors 102 further includes compressor identification information, such as the model and serial numbers of the associated compressor 102, which is communicated to the refrigeration controller 140. The compressor identification information is described in further detail below. The refrigeration controller 140 populates an asset management database 162 that is resident on a remote computer or server 164. The refrigeration controller 140 communicates with remote computer/server 164 to automatically populate the asset management database 162 with information provided by the electronics module 160. In this manner, the asset management database 162 is continuously updated and the status of each component of the refrigeration system 100 is readily obtainable.

The compressor data from the electronics module 160 includes compressor identification information and compressor configuration information. The compressor identification information and the compressor configuration information includes, but is not limited to, the information respectively listed in Table 1 and Table 2, below:

TABLE 1

| Compressor Identification Data | |
|---|---|
| Compressor Model Number | Standard compressor model number |
| Compressor Serial Number | Standard compressor serial number |
| Customer ID Code | Standard customer ID code |
| Location | Identifies customer site |

TABLE 1-continued

| Compressor Identification Data | |
|---|---|
| Application Code | Standard high-temp, med-temp, low-temp |
| Application Temperature Range | Standard high-temp, med-temp, low-temp |
| Refrigerant Code | Refrigerant type |
| Oil Code | Oil type at time of manufacture |
| Oil Charge | Oil amount at time of manufacture or service |
| System Oil Code | Oil type in customer application |
| Display Unit Present | Indicates that a display is attached |
| Expansion Board Present | Indicates that an expansion board is attached to the base board |
| Expansion Board ID Code | Type of expansion board |
| Expansion Board Software | Version number of expansion board software or version number of expansion board driver module for the processor on the base board. |
| Controller Software | Version number of expansion board software for processor on base board. |
| Controller Model Number | Controller board part number |
| Compressor Configuration Code | Provides special configuration status outside the scope of the compressor model number |

TABLE 2

| Compressor Configuration | |
|---|---|
| Anti Short Cycle Time | Enables additional time over minimum OFF time between cycles. |
| Discharge Pressure Cut-In | Pressure cut-in limit when operating with a discharge pressure transducer. |
| Discharge Pressure Cut-Out | Pressure limit when operating with a discharge pressure transducer. |
| Discharge Temp. Trip Reset Time | Hold period after the discharge temperature probe in the compressor indicates a discharge temperature trip has cleared. |
| Discharge Press. Transducer Select | Identifies pressure reading source |
| Suction Press. Transducer Select | Identifies pressure reading source |
| Suction Pressure Cut-Out | Pressure cut-out limit when operating with a suction pressure transducer |
| Suction Pressure Cut-In | Pressure limit when operating with a suction pressure transducer |
| Suction Pressure Multiplier3 | Scales transducer reading to proper units. |
| Suction Pressure Divider3 | Scales transducer reading to proper units. |
| Discharge Pressure Multiplier3 | Scales transducer reading to proper units. |
| Discharge Pressure Divider3 | Scales transducer reading to proper units. |
| Shake Limit | Displacement limit to protect the compressor against a shake condition |
| Oil Add Set Point | Level to add oil |
| Oil Stop Add Set Point | Level to stop adding oil |
| Oil Trip Set Point | Level at which to turn compressor OFF due to lack of lubrication |
| Oil Add Initial Duty Cycle | Starting point for fill duty cycle in an adaptive algorithm for oil fill |
| Oil Add Max Duty Cycle | Limit on fill duty cycle for the adaptive algorithm for oil fill. |
| Enable Reverse Phase Correction | Readout of the signal that originates on the expansion board when a Reverse Phase Correction output module is used |
| Oil Level or Pressure Protection Flag | Type of active oil protection is active |
| Motor PTC or NTC | Type of sensors embedded in motor windings |
| Enable Welded Contactor Single Phase Protection | Readout of the signal that originates on the expansion board when a Single Phase Protection output module is used |

TABLE 2-continued

| Compressor Configuration | |
|---|---|
| Internal or External Line Break | Sets the controller to work with either an internal motor protector or external motor protection via S1-S3 sensors |
| S1, S2, S3 Configuration | Sets the operation mode of the S1-S3 inputs |
| Enable Discharge Temperature Trip Lockout | Enables lockout rather than trip on high discharge temperature. |
| S1 Trip Percent | Trip and reset activation points for the S1-S3 sensors |
| S1 Reset Percent | |
| S2 Trip Percent | |
| S2 Reset Percent | |
| S3 Trip Percent | |
| S3 Reset Percent | |
| Enable Discharge Pressure Trip Lockout | Enables lockout rather than trip on high discharge pressure. |
| Enable Oil Level Trip Lockout | Enables lockout rather than trip on low oil level. |
| Discharge Temperature Probe | Setting (series or separate) used in External Motor Temperature Protection, Discharge Temperature Protection and Discharge Temperature Control |
| Liquid Injection Control | Indicates that a Liquid/Vapor Injection output module is used |
| Discharge Pressure Sensor | Enables or disables the chosen discharge pressure source |
| Suction Pressure Sensor | Enables or disables the chosen suction pressure source |
| Position X Control | Indicates that an output module is plugged into Position X on the board |
| Oil Level Control | Indicates that an Oil Level Control output module is used |
| Discharge Temperature Limit | Discharge temperature cut-out point |
| Discharge Temperature Cut-In | Point below which compressor can be restarted |
| Liquid Inject Temperature | Point above which to start the Liquid/Vapor Injection |
| Liquid Inject Stop Temperature | Point below which to stop injecting Liquid/Vapor |
| TOil Sensor | Enables or disables the given expansion board input |
| TM1 Sensor | |
| TM2 Sensor | |
| TM3 Sensor | |
| TM4 Sensor | |
| T_Spare Sensor | |
| Zero Crossing Detection | Disabled prevents the controller from looking for zero crossings to detect voltage drop-outs |
| Condensing Fan Control | Sets the control mode for condensing fan |
| Position X Control Source | Sets the control mode for Position X on the expansion board |
| Modulation Type | Readout of the signal from the expansion board when one or more modulation output module is/are used |
| Oil Level Sensors | Sets the mode of operation for one or two oil level sensors |
| Disable Reversed Phase Check | Enables reversed phase detection to be disabled |
| Failsafe Mode | Sets the failsafe mode of the electronics module |
| Crankcase Heat Ontime Lockout | Time to remain OFF after a system power up |

The compressor data is preconfigured during manufacture (i.e., factory settings) and is retrieved by the refrigeration system controller 140 upon initial connection of the compressor 102 and its corresponding electronics module. The compressor data can be updated with application-specific settings by the refrigeration system controller or by a technician using the refrigeration system controller 140. The updated compressor data is sent back to and is stored in the electronics module 160. In this manner, the preconfigured compressor data can be updated based on the requirements of the specific refrigeration system 100.

The refrigeration controller 140 monitors the compressors 102 for alarm conditions and maintenance activities. One such example is monitoring for compressor oil failure, as described in further detail below. Because the refrigeration controller 140 stores operating history data, it can provide a failure and/or maintenance history for the individual compressors 102 by model and serial number.

The refrigeration controller 140 is responsible for addressing and providing certain configuration information for the electronics modules 160. This occurs during first power up of the refrigeration system (i.e., finding all electronics modules 160 in the network and providing appropriate address and configuration information for the electronics modules 160), when a previously addressed and configured electronics module 160 is replaced by a new electronics module 160 and when an electronics module 160 is added to the network. During each of these scenarios, the refrigeration controller 140 provides a mapping screen that lists the serial numbers of the electronics modules 160 that are found. The screen will also list the name of each electronics module 160 and the firmware revision information.

In general, a technician who replaces or adds an electronics module 160 is required to enter a network setup screen in the refrigeration controller 140 and inform the refrigeration controller 140 that an electronics module 160 has been added or deleted from the network. When an electronics module 160 is replaced, the technician enters the network setup screen for the electronics modules 160 and initiates a node recovery. During the node recovery, existing electronics modules 160 retain their setup information and any links that the technician has established to the corresponding suction groups. The results are displayed on the network setup screen. The technician has the capability to delete the old electronics module 160 from the refrigeration controller 140.

A cell is created in the refrigeration controller 140 to act as an interface to each electronics module 160. The cell contains all inputs, outputs and configuration setpoints that are available on the particular electronics module 160. In addition, the cell contains event information and a text string that represents the current display code on the electronics module 160. The cell data includes status information, configuration information, control data, event data, ID reply data, ID set data and summary data.

The status information is provided in the form of fields, which include, but is not limited to, display code, compressor running, control voltage low, control voltage dropout, controller failure, compressor locked out, welded contactor, remote run available, discharge temperature, model number, serial number, compressor control contact, liquid injection contact and error condition outputs. The control data enables the technician to set the data that is sent to the electronics module 160 for control. The control data includes, but is not limited to, compressor run request, unloader stage 1 and unloader stage 2. The compressor run request controls the run command to the compressor 102. This is typically tied to a compressor stage in the suction group cell.

With regard to event data, the refrigeration controller 140 has the capability to retrieve and display all of the event codes and trip information present on the particular electronics module 160. The cell provides correlation between the event code, a text display representing the code and the trip time. The screen will also display the compressor cycle information (including short cycle count) and operational time. The summary data is provided on a summary screen in the refrigeration controller 140 that lists the most important status information for each electronics module 160 and displays all electronics modules.

Each electronics module 160 can generate a trip event and/or a lockout event. A trip event is generated when an event occurs for a temporary period of time and generally clears itself. An example of a trip occurs when the motor temperature exceeds the a threshold for a period of time. The electronics module 160 generates a motor temperature trip signal and clears the trip when the motor temperature returns to a normal value. A lockout event indicates a condition that is not self clearing (e.g., a single phase lockout).

The refrigeration controller 140 polls the status of each. electronics module 160 on a regular basis. If the electronics module 160 is in a trip condition, the refrigeration controller 140 logs a trip in an alarm log. Trips are set up as notices in the alarm log. If the electronics module 160 is in a lockout condition, the refrigeration controller 140 generates a lockout alarm in the alarm log. The cell has the capability to set priorities for notices and alarms. It is also anticipated that a lockout can be remotely cleared using the refrigeration controller 140.

When a technician either resets or otherwise acknowledges an alarm or notice associated with the electronics module 160, the appropriate reset is sent to the electronics module 160 to clear the trip or lockout condition. The trips include, but are not limited to, low oil pressure warning, motor protection, supply voltage, discharge pressure, phase loss, no three phase power, discharge temperature and suction pressure. The lockouts include, but are not limited to low oil pressure, welded contactor, module failure, discharge temperature, discharge pressure and phase loss.

With particular regard to the low oil pressure lockout, the electronics module 160 communicates the number of oil resets that have been performed to the refrigeration controller 140. If the number of resets exceeds a threshold value, a problem with the refrigeration system 100 may be indicated. The refrigeration controller 140 can send an alarm or initiate maintenance actions based on the number of lockout resets.

The welded contactor lockout provides each electronics module 160 with the ability to sense when a contactor has welded contacts. It does this by monitoring the voltage applied by the contactor based on whether the electronics module 160 is calling for the contactor to be ON or OFF. If a single phase (or 2 phases) are welded in the contactor and the contactor is inadvertently turned off, this condition can lead to compressor damage. It also affects the ability of the suction pressure control algorithm since the refrigeration controller 140 could be calling for the compressor 102 to be OFF, but the compressor continues to run. To mitigate the problems caused by this condition, the suction pressure algorithm in the refrigeration controller 140 is adapted to recognize this condition via the electronics module 160. When a welded contactor condition is detected, the associated compressor 102 is held ON by the suction group algorithm and the appropriate alarm condition is generated, which avoids damage to the compressor motor.

The technician can readily connect an electronics module equipped compressor 102 into a suction group. All pertinent connections between the electronics module 160 and suction group cells are automatically established upon connection of the compressor 102. This includes the type (e.g., compressor or unloader), compressor board/point (i.e., application/cell/output) and proof of board/point. A screen similar to the mapping screen enables the technician to pick which electronics modules 160 belong to a suction group.

It is further anticipated that additional features can be incorporated into the refrigeration system 100. One feature includes an electronics module/refrigeration controller upload/download, which provides the capability to save the parameters from an electronics module 160 to the refrigeration controller 140. If the saved electronics module 160 is replaced, the parameters are downloaded to the new electronics module 160, making it easier to replace an electronics module in the field.

Another feature includes cell data breakout, which provides a discrete cell output for each trip or alarm condition. The cell output would enable these conditions to be connected to other cell's for analysis or other actions. For example, the discharge temperature lockout status from multiple electronics modules 160 could be connected to a super-cell that reviews the status and diagnoses a maintenance action based on how many electronics modules 160 have a discharge temperature trip and the relative timing of the trips.

Still another feature includes an automatic reset of the lockout conditions in the event of a lockout. More specifically, the refrigeration controller 140 automatically attempts a reset of a lockout condition (e.g., an oil failure lockout) when the condition occurs. If the reset attempt repeatedly fails, an alarm would then be generated.

Yet another feature includes phase monitor replacement. More specifically, a phase monitor is traditionally installed in a compressor rack. The electronics modules 160 can be configured to generate a phase monitor signal, removing the need for a separate phase monitor. If all the electronics modules 160 on a given rack signal a phase loss, a phase loss on the rack is indicated and an alarm is generated.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method comprising:

preconfiguring a data set for a refrigeration component, said data set including identification and configuration parameters of said refrigeration component;

storing said data set in an electronics module associated with said refrigeration component;

copying said data set to a refrigeration system controller in communication with said electronics module;

initially configuring a refrigeration system based on said copied data set; and monitoring an occurrence of one of a trip state and a lockout state of said refrigeration component set by said electronics module.

2. The method of claim 1 further comprising generating an updated data set based on said data set and storing said updated data set in said electronics module.

3. The method of claim 1 wherein said initially configuring a refrigeration system includes communicating said data set for said refrigeration component to said refrigeration system controller upon assembly of said refrigeration component into said refrigeration system.

4. The method of claim 1 further comprising copying at least a portion of said data set to an asset management database from said refrigeration system controller.

5. The method of claim 1 further comprising replacing said electronics module with a replacement electronics module and copying said data set for said electronics module to said replacement electronics module.

6. The method of claim 1 further comprising providing a graphical display of a layout of said refrigeration system including identification information of said electronics module.

7. The method of claim 1 further comprising generating a cell associated with said electronics module, wherein said cell includes inputs, outputs and configuration setpoints related to said refrigeration component.

8. The method of claim 1 further comprising regulating operation of said refrigeration component based on said data set.

9. The method of claim 1 further comprising initiating said lockout state based on one of a voltage and a current condition to said refrigeration component.

10. The method of claim 9 further comprising indicating a welded electrical contact based on said voltage and said current condition.

11. The method of claim 1 further comprising temporarily suspending operation of said refrigeration component until said trip state clears.

12. The method of claim 1 further comprising suspending operation of said refrigeration component until said lockout state is reset.

13. The method of claim 12 further comprising resetting said lockout state by said refrigeration system controller.

14. The method of claim 1 further comprising logging one of said trip state and said lockout state with an associated timestamp.

15. The method of claim 1 further comprising monitoring occurrences of each of said trip state and lockout state.

16. The method of claim 15 further comprising initiating an alarm when one of said trip state and said lockout state has occurred a threshold number of times.

17. The method of claim 1 further comprising basing said trip state on one of a low pressure, a motor temperature, an electronics module voltage supply, a discharge pressure, a phase loss, a discharge temperature and a suction pressure.

18. The method of claim 1 further comprising basing said lockout state on one of a low oil pressure, a welded contactor, an electronics module failure, a discharge temperature, a discharge pressure and a phase loss.

19. In a refrigeration system, a refrigeration component associated with an electronics module including a memory storing a data set specific to said refrigeration component, said data set including identification parameters and configuration parameters of said refrigeration component, a refrigeration system controller in communication with said electronics module to copy said data set from said electronics module and regulate operation of said refrigeration component within said refrigeration system based on said data set, said refrigeration system controller monitoring occurrences of said refrigeration component in one of a trip state and a lockout state.

20. The system of claim 19 wherein said refrigeration system controller is operable to generate an updated data set and transmit said updated data set to said memory of said electronics module.

21. The system of claim 19 wherein said refrigeration system controller is operable to initiate remedial action when said refrigeration component is in said lockout state.

22. The system of claim 21 wherein said remedial action includes at least one of attempting to reset said lock-out state and triggering an alarm if said reset fails.

23. The system of claim 19 wherein said electronics module is operable to communicate said data set to said refrigeration system controller upon assembly of said refrigeration component into a refrigeration system.

24. The system of claim 19 further comprising an asset management database, wherein said refrigeration system controller is operable to update an asset management database based on said data set.

25. The system of claim 19 wherein said refrigeration system controller is operable to query a replacement electronics module that replaces said electronics module upon association of said replacement electronics module with said refrigeration component.

26. The system of claim 25 wherein a replacement data set from said refrigeration system controller is stored in a memory of said replacement electronics module.

27. The system of claim 26 wherein said replacement data set is a copy of said data set from said electronics module being replaced.

28. The system of claim 19 further comprising a display screen associated with said refrigeration system controller and providing a graphical display of a layout of the refrigeration system, including identification information of said refrigeration component.

29. The system of claim 19 wherein said refrigeration system controller generates a cell associated with said electronics module, wherein said cell includes inputs, outputs and configuration setpoints related to said refrigeration component associated with said respective electronics module.

30. The system of claim 19 wherein said electronics module initiates one of a trip event and a lockout event based on an operating condition of said refrigeration component.

31. The system of claim 30 wherein said lockout event indicates potential damage to said refrigeration component and is initiated based on one of a voltage and a current condition to said refrigeration component.

32. The system of claim 31 wherein said one of a voltage and a current condition indicate a welded electrical contact.

33. The system of claim 30 wherein said refrigeration system controller temporarily suspends operation of said refrigeration component during said trip event until a trip condition clears.

34. The system of claim 30 wherein said refrigeration system controller suspends operation of said refrigeration component during said lockout event until a lockout condition is reset.

35. The system of claim 34 wherein said refrigeration system controller is operable to reset said lockout condition.

36. The system of claim 30 wherein said refrigeration system controller is operable to log said trip events and said lockout events and record an associated timestamp.

37. The system of claim 30 wherein said refrigeration controller is operable to monitor occurrences of each of said trip and lockout events and initiate an alarm when at least one of said trip and lockout events has occurred a threshold number of times.

38. The system of claim 30 wherein said trip event is based on at least one of a low pressure, a motor temperature, an electronics module voltage supply, a discharge pressure, a phase loss, a discharge temperature and a suction pressure.

39. The system of claim 30 wherein said lockout event is based on at least one of a low oil pressure, a welded contactor, an electronics module failure, a discharge temperature, a discharge pressure and a phase loss.

40. The system of claim 19 further comprising a plurality of refrigeration components and a plurality of electronics modules, each said electronics module associated with one of said plurality of refrigeration components, said memory of each of said electronics modules storing said data set including identification and configuration parameters of a respective refrigeration component, and wherein said refrigeration system controller receives said data sets from each of said electronics modules and regulates operation of each of said refrigeration components within said refrigeration system.

41. The system of claim 40 wherein each of said electronics modules communicates its respective data set to said refrigeration system controller upon assembly of said associated refrigeration component into said refrigeration system.

42. The system of claim 40 wherein said refrigeration system controller queries a replacement electronics module that replaces one of said electronics modules upon connection of said replacement electronics module into said refrigeration system.

43. The system of claim 42 wherein said refrigeration system controller generates a replacement data set and said replacement data set is stored in a memory of said replacement electronics module.

44. The system of claim 42 wherein said replacement data set is a copy of said data set from said electronics module being replaced.

45. The system of claim 40 wherein said refrigeration system controller generates a cell associated with each of said electronics modules, wherein said cell includes inputs, outputs and configuration setpoints related to said refrigeration component.

46. The system of claim 40 wherein said refrigeration system controller regulates operation of each of said refrigeration components based on said respective data set.

47. In a refrigeration system, a refrigeration component associated with an electronics module including a memory storing a data set specific to said refrigeration component, said data set including identification parameters and configuration parameters of said refrigeration component, a refrigeration system controller in communication with said electronics module to copy said data set from said electronics module and regulate operation of said refrigeration component within said refrigeration system based on said data set, said electronics module initiating one of a trip event and a lockout event based on an operating condition of said refrigeration component.

48. The system of claim 47 wherein said lockout event indicates potential damage to said refrigeration component and is initiated based on one of a voltage and a current condition to said refrigeration component.

49. The system of claim 48 wherein said one of a voltage and a current condition indicate a welded electrical contact.

50. The system of claim 47 wherein said refrigeration system controller temporarily suspends operation of said refrigeration component during said trip event until a trip condition clears.

51. The system of claim 47 wherein said refrigeration system controller suspends operation of said refrigeration component during said lockout event until a lockout condition is reset.

52. The system of claim 51 wherein said refrigeration system controller is operable to reset said lockout condition.

53. The system of claim 47 wherein said refrigeration system controller is operable to log said trip events and said lockout events and record an associated timestamp.

54. The system of claim 47 wherein said refrigeration controller is operable to monitor occurrences of each of said trip and lockout events and initiate an alarm when at least one of said trip and lockout events has occurred a threshold number of times.

55. The system of claim 47 wherein said trip event is based on at least one of a low pressure, a motor temperature, an electronics module voltage supply, a discharge pressure, a phase loss, a discharge temperature and a suction pressure.

56. The system of claim 47 wherein said lockout event is based on at least one of a low oil pressure, a welded contactor, an electronics module failure, a discharge temperature, a discharge pressure and a phase loss.

* * * * *